United States Patent [19]

Moharram

[11] Patent Number: 4,752,984

[45] Date of Patent: Jun. 28, 1988

[54] DENTAL BRACE TOOTHBRUSH

[76] Inventor: Miryam M. Moharram, 3312 Phaeton Ct., Plano, Tex. 75023

[21] Appl. No.: 22,767

[22] Filed: Mar. 6, 1987

[51] Int. Cl.[4] ..... A46B 9/04

[52] U.S. Cl. ..... 15/167.1; 15/143 R; D4/104

[58] Field of Search ..... 15/167 R, 143 R, 110; D4/104–114

[56] References Cited

U.S. PATENT DOCUMENTS

| | | | |
|---|---|---|---|
| D. 139,524 | 11/1944 | Laskin | 15/167 R |
| D. 156,134 | 11/1949 | Lodewick et al. | D4/108 |
| D. 170,095 | 7/1953 | Schotland | D4/108 |
| 2,121,373 | 6/1938 | Turner | 15/167 R |
| 2,483,503 | 10/1949 | Pollack | 15/167 R |
| 3,754,295 | 8/1973 | Hyman | 15/167 R |
| 4,542,552 | 9/1985 | d'Argembeau | D4/104 X |

*Primary Examiner*—Peter Feldman

*Attorney, Agent, or Firm*—Kanz, Scherback & Timmons

[57] ABSTRACT

Disclosed is a toothbrush and a method for cleaning teeth having a dental brace mounted thereon. The toothbrush includes a handle and a head portion on one end of the handle. A plurality of bristles are mounted on the head portion and arranged into a single longitudinally aligned row for receipt of toothpaste or the like. The head portion may be presented parallel to the teeth and the bristles inserted between the dental brace and the side of the teeth. Food particles, plaque and other contaminates may be removed from the teeth by a reciprocal motion of the toothbrush with respect to the teeth.

2 Claims, 1 Drawing Sheet

DENTAL BRACE TOOTHBRUSH

FIELD OF THE INVENTION

This invention relates generally to toothbrushes and in particular to a toothbrush for cleaning teeth having a dental brace mounted thereon.

BACKGROUND OF THE INVENTION

Various toothbrush designs have been employed in the past for cleaning teeth of food deposits, plaque and other undesirable contaminants. However, a certain percentage of the population have, as shown in FIG. 1A, a dental brace 10 mounted on their teeth (only one of which is shown) for orthodontic reasons. Typically, such dental braces include a bracket 14 mounted on each tooth 12 and a metal wire or chain 16 that connect the brackets. The wires and chains are spaced from the exterior of the teeth. Food deposits, plaque and other contaminants have an undesirable tendency to accumulate in the space between the dental brace and the exterior surface of the teeth, with obvious adverse health effects. Conventional toothbrush designs (as at 18) typically include an elongated handle (not shown) terminating in a head portion 20. A plurality of bristles 22 are mounted on the head, commonly in groups or tufts arranged into a pattern of multiple rows and columns. The toothbrush is constructed so that the head portion is inserted into a mouth with the bristles coated with toothpaste (not shown) or the like and presented perpendicularly to the side of the tooth. The tooth is cleaned by a reciprocal upward and downward motion (as at 24) of the bristles.

However, in the case of teeth having a dental brace mounted on them, conventional toothbrush designs are inadequate. That is, the perpendicular orientation of the bristles with respect to the teeth prevents the bristles from penetrating between the dental brace and the teeth. As is shown in FIG. 1B, the width and thickness of the conventional toothbrush head make it difficult if not impossible to rotate the bristles so that they are parallel to the teeth, and even if this is accomplished, the multiple rows of bristle tufts prevent the innermost row of tufts from penetrating between the dental brace and the teeth. Even inclining the head with respect to the handle of the toothbrush cannot overcome this inherent limitation of existing designs.

SUMMARY OF THE INVENTION

This invention provides a method and apparatus in the form of a toothbrush for cleaning teeth having a dental brace mounted thereon. The method includes the steps of providing a toothbrush having a handle and a head; providing a plurality of flexible bristles mounted on said head; arranging the bristles in a single row of longitudinally aligned spaced tufts on the head; presenting the bristles of the toothbrush substantially parallel to a tooth; inserting the bristles between the tooth and the dental brace; and dislodging the food deposits from the tooth through reciprocal motion of the toothbrush.

The apparatus provided to practice this method includes, in one embodiment, a handle defining a longitudinal axis and a vertical plane intersecting the longitudinal axis of the handle; a head mounted on one end of the handle and defining a first surface; and a plurality of flexible bristles mounted on the first surface of the head and arranged in a single row of one or more spaced tufts generally within the vertical plane of the handle for penetration between a tooth and the dental brace so as to dislodge food deposits or the like therefrom.

Therefore, it is a principal feature and advantage of this invention to provide an improved dental brace toothbrush and method.

It is another feature and advantage of this invention to provide an improved dental brace toothbrush and method for penetration between a tooth and a dental brace.

BRIEF DESCRIPTION OF THE DRAWINGS

So that the manner in which the above recited features and advantages of the invention, as well as others which will become apparent to those skilled in the art, are obtained and can be understood in detail, a more particular description of the invention briefly summarized above may be had by reference to the embodiments thereof which are illustrated in the accompanying drawings, which drawings form a part of the specification and in which like numerals depict like parts in the several views. It is noted, however, that the appended drawings illustrate only a preferred embodiment of the invention and are therefore not to be considered limiting of its scope, for the invention may admit to other equally effective embodiments.

DETAILED DESCRIPTION OF THE INVENTION

Figure 2:
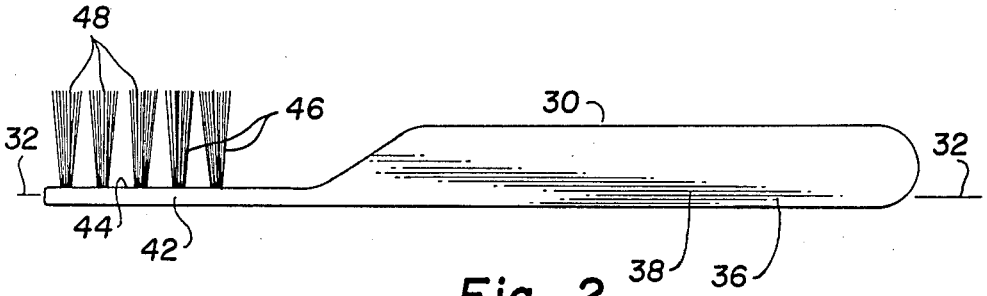
FIG. 2 is a side view of a toothbrush according to the present invention.
Figure 3:
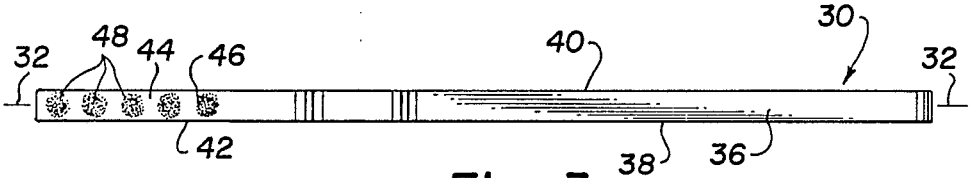
FIG. 3 is a top view of the toothbrush of FIG. 2.
Figure 4:
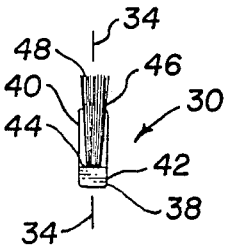
FIG. 4 is an end view of the toothbrush of FIG. 2.

Referring now to FIGS. 2–4, there is shown a toothbrush 30 constructed according to the present invention. The toothbrush is preferably constructed from a strong, lightweight material and formed into a monolithic molded body. The body of the toothbrush defines a longitudinal axis 32 and a vertical plane 34 intersecting the longitudinal axis along the length of the toothbrush. The toothbrush includes a handle 36 adapted for manual engagement. Preferably, the handle includes opposing side surfaces 38 and 40 on either side of the vertical plane and parallel thereto.

Figure 1A:
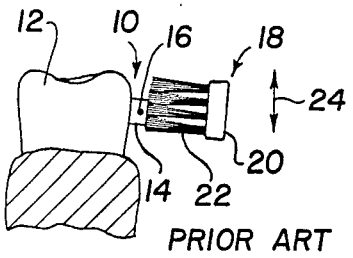
FIG. 1A is a magnified view in detail of a conventional toothbrush applied to a tooth having a dental brace mounted thereon.
Figure 1B:
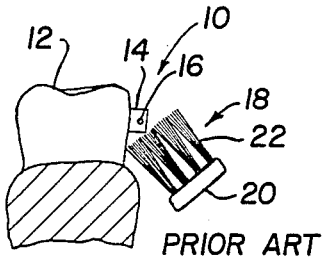
FIG. 1B is a magnified view in detail of the conventional toothbrush of FIG. 1A inclined with respect to the tooth.

Head portion 42 is mounted on one end of the handle for insertion into the mouth of the user of the toothbrush. The head includes a surface 44 and a plurality of flexible, elongated bristles 46 mounted on the head. The bristles are mounted in one or more tufts or groups 48, with the tufts spaced from each other arranged in a single longitudinally aligned row and the bristles extending upwardly from the surface 44 generally within the vertical plane 34 and between the opposing sides 38 and 40. The bristles 46 are adapted for the application of toothpaste (not shown) or the like to the tops of the bristles. It will be observed as in FIG. 4, that the width of the head portion 42 is relatively narrow compared to conventional toothbrushes, as shown in FIGS. 1A and 1B, and in particular is only slightly wider than the tufts of bristles. Also, as shown in the drawings, the width of the head 42 is substantially the same as the width of the handle. As shown in FIG. 2, the vertical distance between the upper and lower surfaces of the handle is at least half the length of the bristles.

Figure 5:
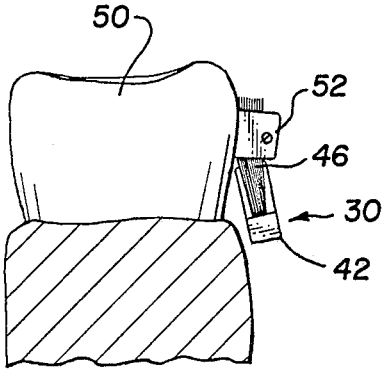
FIG. 5 is a view of the toothbrush of FIG. 2 applied to a tooth having a dental brace mounted thereon.

In operation, and as is shown in FIG. 5, the head portion 42 of the toothbrush is presented generally parallel to the side of a tooth 50 (i.e. 90° from the orientation of conventional toothbrushes). The desired orientation of the head portion and the bristles 46 with respect to the tooth is inherently accomplished by manually gripping the sides 38 and 40 of the handle in a natural manner. The extreme narrowness of the head portion enables the bristles to be placed closely adjacent to the side of the tooth. In this position, the bristles may be easily inserted in between the wire 52 of the dental brace and the front surface of the tooth. The tooth may thus be thoroughly cleaned of all food deposits, plaque and other contaminants normally inaccessible to conventional toothbrushes, perferably by a reciprocal front-to-back or side-to-side motion relative to the tooth. This process is easily and quickly repeated to clean all the teeth.

Although the invention has been disclosed above, with regard to particular and preferred embodiments, these are advanced for illustrative purposes only, and are not intended to limit the scope of this invention. For instance, depending on the construction of the dental brace and its spacing from the side of the teeth, it is possible to provide a toothbrush according to this invention that includes tufts of bristles mounted in multiple rows on the head portion while still enabling the bristles to penetrate between the dental brace and tooth; or in which the head portion is inclined with respect to the handle. These and other variations remain within the invention as claimed below.

What is claimed is:

1. A toothbrush for removing food deposits or the like from a tooth having a dental brace mounted thereon, comprising:

(a) a handle defining a longitudinal axis and a vertical plane intersecting said longitudinal axis of said handle, said handle including opposing flat side surfaces on either side of the vertical plane and parallel thereto;

(b) a head mounted on one end of said handle along said longitudinal axis and defining a first surface; and (c) a plurality of flexible bristles mounted on said first surface of said head and arranged in a single row of one or more spaced tufts generally between the opposing flat side surfaces of said handle for penetration between the tooth and the dental brace so as to dislodge food deposits therefrom, the width of the head being substantially the same as the width of the handle and only slightly wider than one of the tufts of bristles, and the vertical distance between the upper and lower surfaces of the handle being at least half the length of the bristles.

2. The toothbrush of claim 1, wherein the combination handle and head is formed from a monolithic molded body.

* * * * *